US005941373A

United States Patent [19]

Cheng

[11] Patent Number: 5,941,373

[45] Date of Patent: Aug. 24, 1999

[54] INTEGRATED KEYBOARD KEY ASSEMBLY

[75] Inventor: Tsung-Kan Cheng, Taipei, Taiwan

[73] Assignee: Mustke Corporation, Taipei Hsien, Taiwan

[21] Appl. No.: 08/866,449

[22] Filed: May 30, 1997

[51] Int. Cl.[6] ..... H01H 13/70

[52] U.S. Cl. ..... 200/344

[58] Field of Search ..... 200/5 A, 512, 200/517, 341, 344, 345; 400/490, 495, 495.1, 472, 473, 480, 491.2, 496

[56] References Cited

U.S. PATENT DOCUMENTS

| | | | |
|---|---|---|---|
| 4,392,037 | 7/1983 | Fleming | 200/340 |
| 4,453,063 | 6/1984 | Wanatowicz, Jr. et al. | 200/340 |
| 4,468,145 | 8/1984 | Denley | 400/496 |
| 4,475,832 | 10/1984 | Wachs | 400/496 |
| 4,535,210 | 8/1985 | Shedore et al. | 200/340 |
| 4,771,146 | 9/1998 | Suzuki et al. | 200/340 |
| 4,802,779 | 2/1989 | Allaire | 400/496 |
| 4,830,526 | 5/1989 | Hosono | 400/490 |
| 4,950,093 | 8/1990 | Ertl | 400/496 |
| 5,003,140 | 3/1991 | Abell, Jr. et al. | 200/344 |
| 5,278,372 | 1/1994 | Takagi et al. | 200/344 |
| 5,376,765 | 12/1994 | Holmes et al. | 200/344 |
| 5,387,261 | 2/1995 | Yamada et al. | 400/490 |
| 5,512,719 | 4/1996 | Okada et al. | 200/344 |
| 5,630,501 | 5/1997 | Tsay | 200/344 |
| 5,668,358 | 9/1997 | Wolf et al. | 200/5 A |
| 5,669,723 | 9/1997 | Chang | 400/496 |

*Primary Examiner*—Michael Friedhofer
*Attorney, Agent, or Firm*—Arnold White & Durkee

[57] ABSTRACT

A multiple-key key assembly includes an integrated key top and key base unit with a built-in stabilizer. The key top includes a key plunger for mating with a key plunger guide provided in the key seat of a keyboard to support the key assembly on the keyboard and for making key stroke contacts with depression of the key top. The stabilizer includes a swing rod connected in a movable fashion between the key top and the key base. When eccentric actuation occurs from the top of the key top, the eccentric force is deflected by the swing rod and uniform force transmission is achieved to provide smooth operation of the integrated key. A support plunger provided in the key top is guided by a support plunger guide provided in the key base for added stability. The integrated structure with the built-in stabilizer allows the integrated key assembly to be adapted to a wide range of multiple-key applications, including double and quad keys. The integrated key assembly can be easily assembled to or disassembled from the keyboard by connecting or disconnecting the key plunger to the key plunger guide without the need for special tools.

19 Claims, 5 Drawing Sheets

INTEGRATED KEYBOARD KEY ASSEMBLY

FIELD OF THE INVENTION

This invention relates generally to keyboard switch assemblies for inputting data to computers and other electronic devices and, more particularly, to an integrated keyboard key assembly with a built-in balancing mechanism for preventing the key from tilting or rotating when the key top on the key is pressed eccentrically by an operator.

BACKGROUND OF THE INVENTION

A known mechanism for preventing key tops from tilting and rotating employs an element known as a U-shaped wire or swing rod rotatably supported between a key top and a corresponding key seat. This mechanism minimizes the tipping moments that may be applied to the key plunger guide which guides the strokes of the key top on the key seat when the force exerted on the key top and the key plunger is not directly over the center above the key plunger guide. Small keys such as typical single keys do not require a swing rod mechanism to maintain their orientations because forces generated by normal use are small enough to be resisted by key plunger guides in an incorporated electrical switch. The problem is common for large keys or so-called multiple-key keys that span over multiple key seats. When a multiple-key key not equipped with a swing rod mechanism is depressed at its edge eccentrically, a higher force of actuation is demanded because of the tipping moments caused by the eccentric loading that produce higher friction in the key plunger guide.

For large key tops or so-called multiple-key key tops, the swing rod is connected in a movable fashion between the key top and the key seat. A sketch of a typical swing rod 20 for use with a large key top 10 is shown in FIG. 1. When eccentric actuation occurs from the top of the key top 10, the eccentric force is deflected by the swing rod 20 which is rotatably supported in the keyboard adjacent the key seat by supports 30 and transmitted to the opposite edge of the key top 10. Consequently, even if the key is actuated eccentrically, the opposite side of the key top 10 is also pulled down by means of the swing rod 20, and uniform force transmission is achieved and the key plunger guide 40 in the key seat is free of any significant tipping moments. Examples of swing rod mechanisms for use in multiple-key keys are illustrated in a number of references, e.g., U.S. Pat. No. 5,387,261 to Yamada et al. (Feb. 7, 1995); U.S. Pat. No. 5,003,140 to Abell, Jr. et al. (Mar. 26, 1991); U.S. Pat. No. 4,950,093 to Ertl (Aug. 21, 1990); U.S. Pat. No. 4,830,526 to Hosono (May 16, 1989); and U.S. Pat. No. 4,771,146 to Suzuki et al. (Sept. 13, 1988), which are hereby incorporated by reference.

Large multiple-key key tops are assembled to respective key seats provided on a keyboard in several steps using special tools because a swing rod mechanism must be installed to the large key tops and to their respective key seats. On the other hand, the absence of a swing rod mechanism permits assembly of small key tops to respective key seats in a single-step operation, resulting in substantial savings in manufacturing costs.

To improve the efficiency of the assembly of the multiple-key key tops to the key seats, a number of mechanisms have been proposed. For instance, Ertl '093 discloses a support mechanism that includes a means for maintaining the swing rod at an oblique position relative to the key seat during assembly and a guide mechanism for guiding and receiving the pair of free ends of the U-shaped swing rod to the key seat. Abell '140 discloses the use of a key top stabilizer that is integrated with the key top and has a serpentine flexible connecting section interconnecting the key top to a pair of arms that extend to a shaft for engaging pivots provided in the key seat during assembly. The pair of arms and the shaft form a structure similar to that of the traditional swing rod, but are integrated with the key top. Yamada '261 discloses a mechanism for single-step assembly of keys to respective key seats using a semilunar recess that is affixed to each key top and can be snapped over a swing rod during assembly of the keyboard switch. The swing rod is rotatably affixed to and supported by the key seat in a position permitting the semilunar recess to snap onto it in a single step for assembly.

SUMMARY OF THE INVENTION

There is a need for a more efficient, simple mechanism for mounting and replacing multiple-key key tops to a keyboard easily without the need for tools.

It is a feature of this invention to provide a multiple-key key with an integrated key base and a built-in swing rod mechanism.

It is another feature of the invention to provide a multiple-key key that can be easily inserted via a key plunger into the corresponding key slot or plunger guide without the need for special tools or the need to assemble an external swing rod mechanism.

It is another feature of this invention to provide a multiple-key key that can be easily adapted to replace multiple single keys without the need to reconfigure the keyboard.

In accordance with one aspect of the present invention, a key assembly for use on a keyboard comprises a key top having a first constraint, a key plunger for detachably penetrating through a key plunger guide provided in the keyboard, and at least one support plunger extending generally parallel to and spaced from the key plunger. A key base is provided with at least one support plunger guide through which the at least one support plunger movably extends and a second constraint spaced from the first constraint. The at least one support plunger guide is supported on at least one corresponding key plunger guide provided in the keyboard. The key assembly further includes a swing rod having a center portion, a first arm extending from the center portion to a first tip that is spaced from and generally parallel to the center portion, and a second arm extending from the center portion to a second tip that is spaced from and generally parallel to the center portion. The center portion is rotatably and slidably connected to the first constraint and the first and second tips are rotatably connected to the second constraint.

In accordance with another aspect of the invention, a multiple-key unit comprises a U-shaped wire having a cross-part extending to two free ends that are substantially parallel to the cross-part. A base portion is provided with at least one guiding support and a wire guide rotatably and slidably connected to the cross-part. The multiple-key unit further comprises a top portion including a wire support rotatably connected to the two free ends and a contact leg for releasably mating with a first contact guide provided in a keyboard. The top portion has at least one support leg slidably disposed in the at least one guiding support and supported by a second contact guide provided in the keyboard.

Another aspect of this invention is a keybutton assembly comprising a key top which includes a mating stem extending in a first direction for disengageably mating with a mating sleeve and contacting a key contact provided in a keyboard. The keybutton assembly further includes a key bottom and a means for supporting the key top with respect to the key bottom for balanced movement generally in the first direction between a pressed position with the application of a pressure on the key top and a relaxed position upon the release of the pressure. The mating stem is spaced from the key contact in the relaxed position and contacts the key contact in the pressed position.

BRIEF DESCRIPTION OF THE DRAWINGS

The preferred embodiments of this invention, illustrating all their features, will now be discussed in detail. These embodiments depict the novel and nonobvious keyboard key assembly of this invention shown in the accompanying drawings, which are included for illustrative purposes only. These drawings include the following figures, with like numerals indicating like parts.

DETAILED DESCRIPTION OF THE INVENTION

The integrated keyboard key design of this invention may be used for various large key tops or multiple-key key tops. The double key top 1A, triple key top 1B, and quad key top 1C are described herein. It is understood, however, that other multiple-key key top designs may also be achieved based on this disclosure, and are within the scope of the present invention.

A. Double Key

Figure 1:
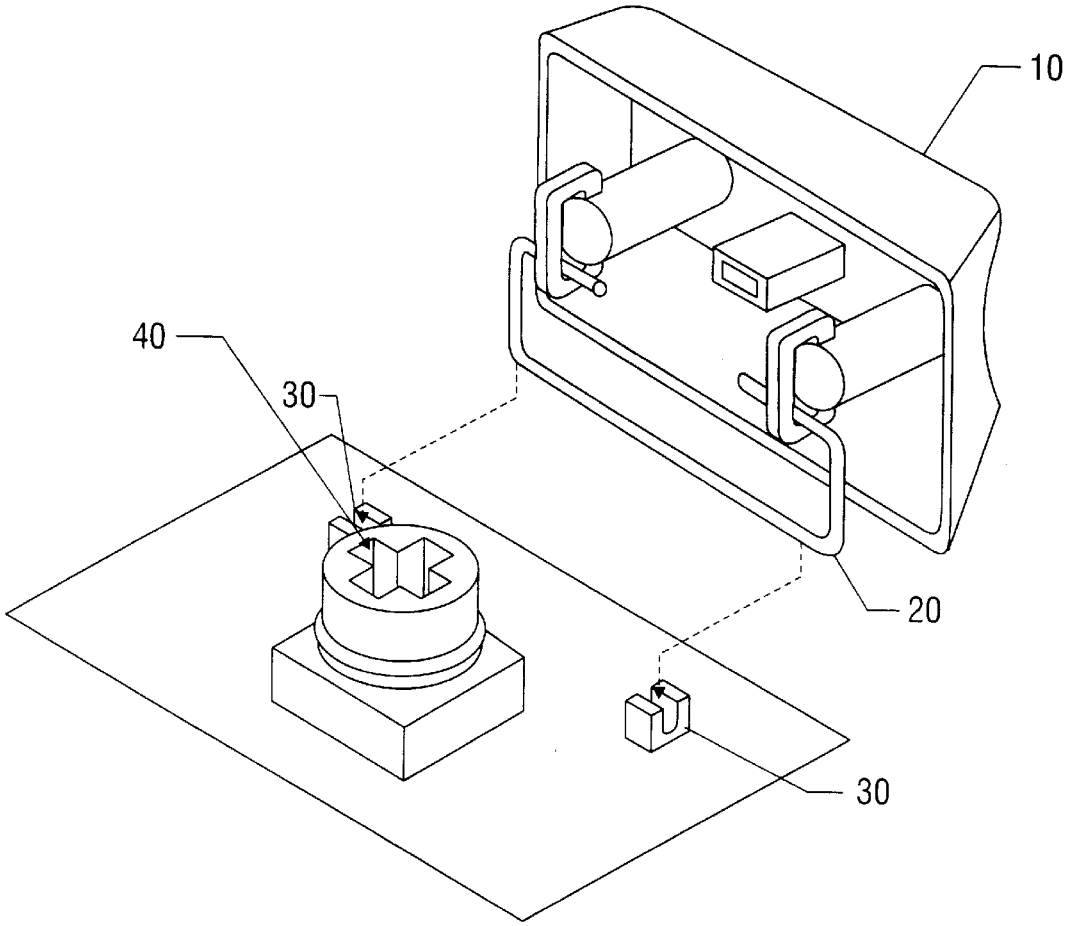
FIG. 1 (Prior Art)
FIG. 1 is a schematic illustration of a prior swing rod mechanism for a large key.
Figure 2:
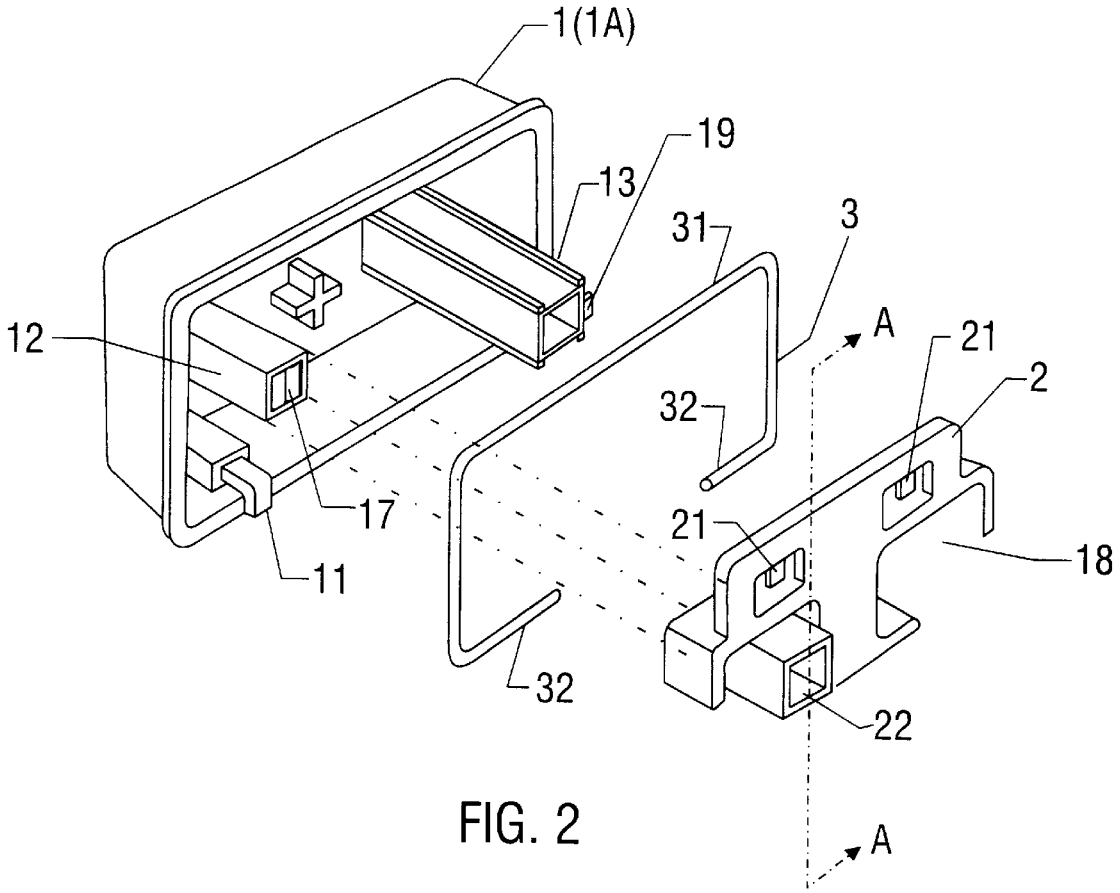
FIG. 2 is an exploded perspective view illustrating an embodiment of a double integrated keyboard key assembly of the present invention.

Referring to FIG. 2, a double integrated keyboard key or keybutton assembly comprises a double key top or key top 1A, a key bottom, key base, or key bracket 2, and a swing rod or U-shaped wire 3. The swing rod 3 is a generally U-shaped member that includes a center portion, cross-part, or shaft portion 31 extending with a pair of arms to a pair of swing tips or free ends 32 that are desirably inwardly bent. The swing rod 3 advantageously has a generally uniform, round cross-section. The swing rod 3 may be made of bent metal such as aluminum or steel.

The key top 1A has a length that is longer than its width, with the length and width defining a generally horizontal plane. A contact leg, mating stem, or key plunger 13 extends from the interior surface of the key top 1A generally vertically and downwardly toward the key base 2. A support leg, stem, or plunger 12 is spaced from the key plunger 13 along the length of the key top 1A and desirably extends in generally the same direction as the key plunger 13. The support plunger 12 is desirably shorter than the key plunger 13. The key plunger 13 advantageously has a tab or protrusion 19 near its bottom end toward the key base 2. The key top 1A further includes a wire support which may comprise a pair of upper restraints, supports, grooves, hooks, slots, or stoppers 11 that are desirably disposed near a rear edge and spaced along the length of the key top 1A. The upper stoppers 11 extend toward the rear edge of the key top 1A and are desirably sized to engage the swing rod 3. Although one upper stopper 11 may be sufficient, a pair of upper stoppers 11 are advantageously provided for stability. The pair of upper stoppers 11 are desirably spaced such that they may engage either the center portion 31 or the pair of swing tips 32 (as shown in FIG. 2) of the swing rod 3. The upper stoppers 11 are advantageously sized to permit rotation or to permit both rotational and horizontal sliding motions of the swing tips 32 relative to the upper stoppers 11.

As shown in FIG. 2, the key base 2 is generally vertically spaced from the key top 1A and includes a wire guide which may comprise a pair of lower restraints, supports, grooves, hooks, or slots 21 disposed generally along the front edge and spaced along the length of the key base 2. The lower slots 21 extend toward the front edge of the key base 2 and are desirably sized to engage the swing rod 3. The lower slots 21 are advantageously spaced from the upper stoppers 11 in a manner to support the swing rod 3 for balanced vertical displacements between the key top 1A and the key base 2 as required to achieve the proper key stroke for a given keyboard. Although one lower slot 21 may be sufficient, a pair of lower slots 21 are advantageously provided for stability. The pair of lower slots 21 are desirably spaced such that they may engage the center portion 31 (as shown in FIG. 2). The lower slots 21 are advantageously sized to permit rotation or to permit both rotational and horizontal sliding motions of the center portion 31 of the swing rod 3. In the embodiment shown in FIG. 2, the upper stoppers 11 are sized to permit both rotational and horizontal sliding motions of the swing tips 32 and the lower slots 21 are sized to permit generally only rotation of the center portion 31 of the swing rod 3 for stability and balance. It is understood that the positions of the upper stoppers 11 and lower slots 21 may shift along the width of the double key without affecting the function of the swing rod 3.

The key base 2 of FIG. 2 further includes a support plunger guide, stem guide, mating sleeve, or guiding support 22 providing a hollow channel of a size through which the support plunger 12 of the key top 1A may extend generally vertically. Advantageously, the support plunger guide 22 provides sufficient clearance in the hollow channel to allow the support plunger 12 to move freely therethrough. The support plunger 12 and support plunger guide 22 are provided to facilitate assembly of the key top 1A to the key base 2 by positioning them relative to each other. In one embodiment, a mechanism such as a small tab or stopper (not shown) inside the hollow channel of the support plunger guide 22 may advantageously be used to engage a small hook 17 at the free end of the support plunger 12 to prevent the support plunger 12 from sliding completely out of the hollow channel and becoming disengaged from the support plunger guide 22. The key plunger 13 of the key top 1A advantageously extends past the key base 2 when assembled. FIG. 2 shows an open region 18 in the key base 2 to accommodate the key plunger 13. The key top 1A and key base 2 may be made of any suitable material such as plastic, and may be formed by molding.

Figure 3:
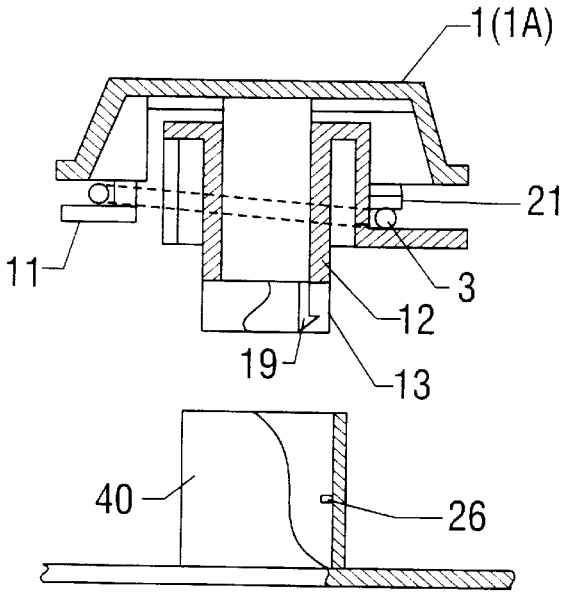
FIG. 3 is a partial cross-sectional view illustrating the assembled double integrated keyboard key assembly of FIG. 2 along line A—A.

Referring to the assembled key shown in FIG. 3, the swing tips 32 are snapped onto the upper stoppers 11 of the double key top 1A and the center portion 31 of the swing rod 3 is snapped onto the lower slots 21 of the key base 2. Advantageously, the center portion 31 is rotatable relative to the lower slots 21 and the swing tips 32 are rotatable and horizontally slidable relative to the upper stoppers 11. The key top 1A is allowed to travel vertically relative to the key base 2 between a top position and a bottom position during a key stroke, while the swing rod 3 moves by rotation of the center portion 31 and rotation and horizontal sliding motion of the swing tips 32, and balances the forces along the length of the double key. The support plunger 12 also moves vertically inside the support plunger guide 22. The support plunger 12 is desirably not long enough to extend through the support plunger guide 22.

To assemble the key assembly with the keyboard, the key plunger 13 is inserted into a key slot, contact guide, or stem guide 40 provided in a key seat of the keyboard as shown in FIG. 3. The key guide 40 of the key seat resiliently supports the key plunger 13 for movement of the key plunger 13 during compression of a key stroke to produce a key contact or electrical contact. Advantageously, a hook or support 26 in the key guide 40 engages the tab or protrusion 19 of the key plunger 13 to support the key plunger 13 relative to the key guide 40. The support plunger 12 and plunger guide 22 advantageously rest on top of another key guide (not shown) of an adjacent key seat for stabilized support of the double key. Because the support plunger 12 is not long enough to penetrate the support plunger guide 22 into the key guide, the contact provided inside the key guide becomes a dummy contact. The support plunger 12 acts as a false or dummy key plunger and the support plunger guide 22 acts as a false or dummy key plunger housing. The key base 2 may also advantageously be supported on the keyboard.

The swing rod 3 ensures that uniform force transmission is achieved for smooth operation of the double key and the key guide 40 is free of any significant tipping moments even when the key top 1A is actuated eccentrically. The eccentric force is deflected by the swing rod 3 which is rotatably supported in the front edge of the integrated key base 2 and transmitted to the opposite rear edge of the key top 1A. The swing rod 3 supported between the key base 2 and key top 1A balances the eccentric force and are advantageously provided so that the double key can be adapted to replace two single keys by occupying two single key slots.

Figure 4:
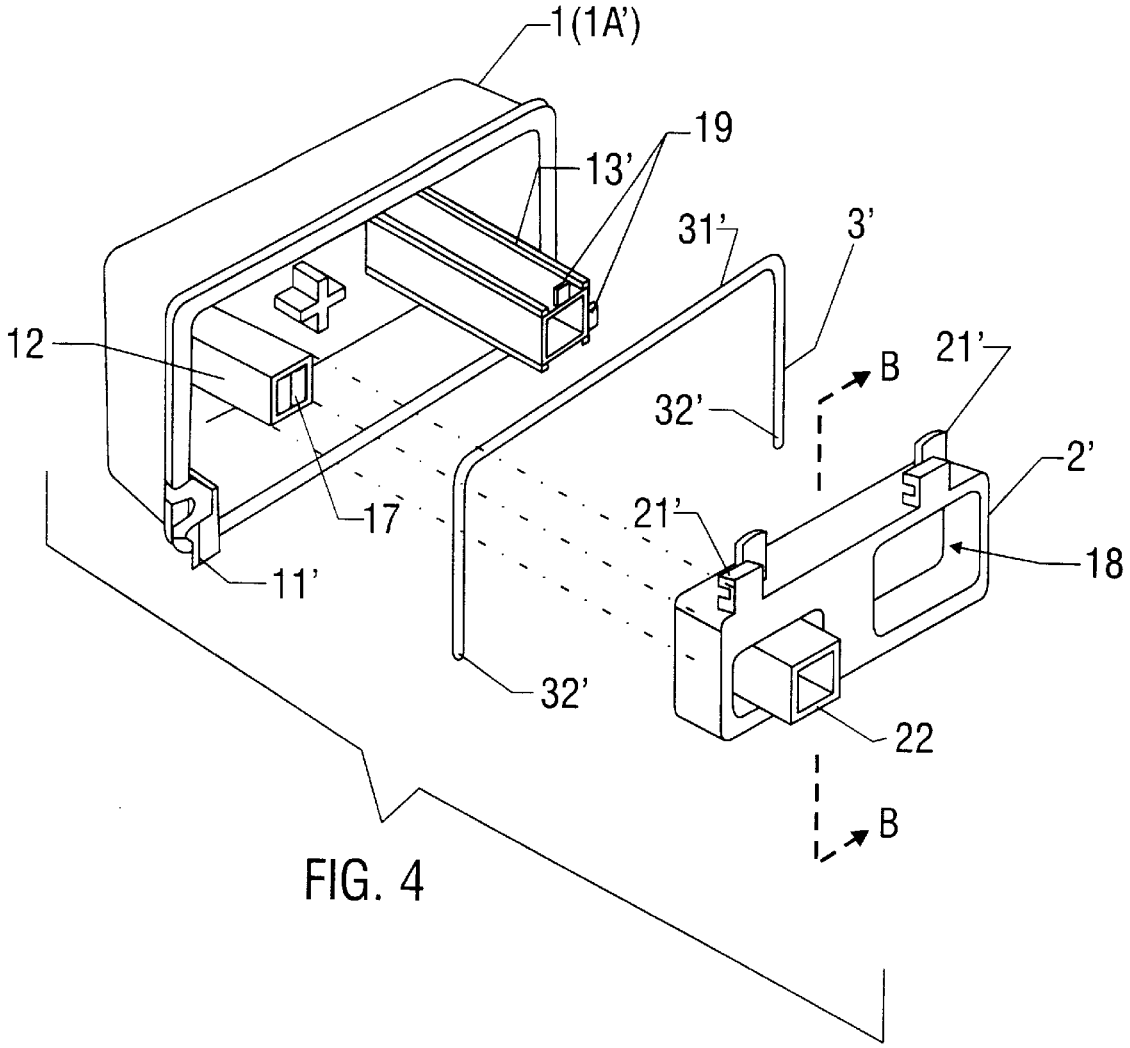
FIG. 4 is an exploded perspective view illustrating another embodiment of a double integrated keyboard key assembly of the present invention.
Figure 5:
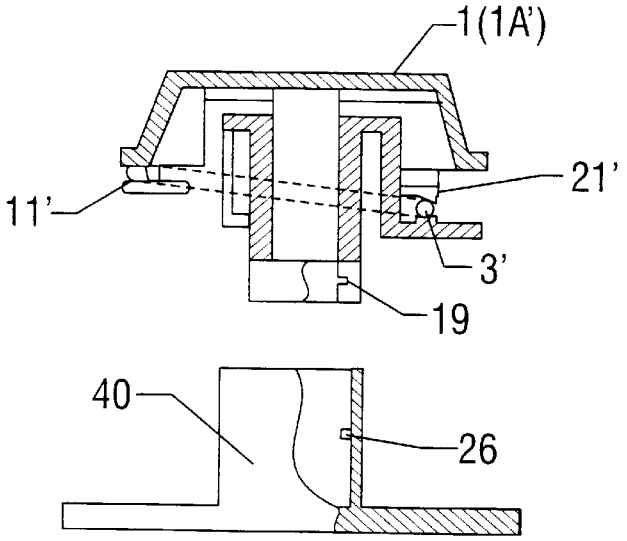
FIG. 5 is a partial cross-sectional view illustrating the assembled double integrated keyboard key assembly of FIG. 4 along line B—B.

Another embodiment of the double integrated keyboard key assembly is shown in FIGS. 4 and 5. In this embodiment, the swing rod 3' is also a generally U-shaped member that includes a center portion 31' extending with a pair of arms to a pair of swing tips or free ends 32' that are not inwardly bent as opposed to the inwardly bent free ends 32 shown in FIG. 2. In place of the upper stoppers 11 of FIG. 2, a pair of upper restraints or stoppers 11' in this embodiment are disposed near the corners of the key top 1A' to engage and support the free ends 32' of the swing rod 3'. This embodiment illustrates a different mechanism for connecting the swing rod 3' to the key top 1A'. It is understood that other similar mechanisms are also within the scope of this invention.

As best seen in FIG. 4, the key plunger 13' of the key top 1A' includes a pair of tabs or protrusions 19' near its bottom end toward the key base 2. Either of the two tabs 19' may engage the hook or support 26 provided in the key guide 40 to support the key plunger 13' relative to the key guide 40. As a result, the double key may be oriented in different directions relative to the keyboard, either along a row or a column of keys, thereby making the key more versatile.

B. Triple Key

Figure 6A:
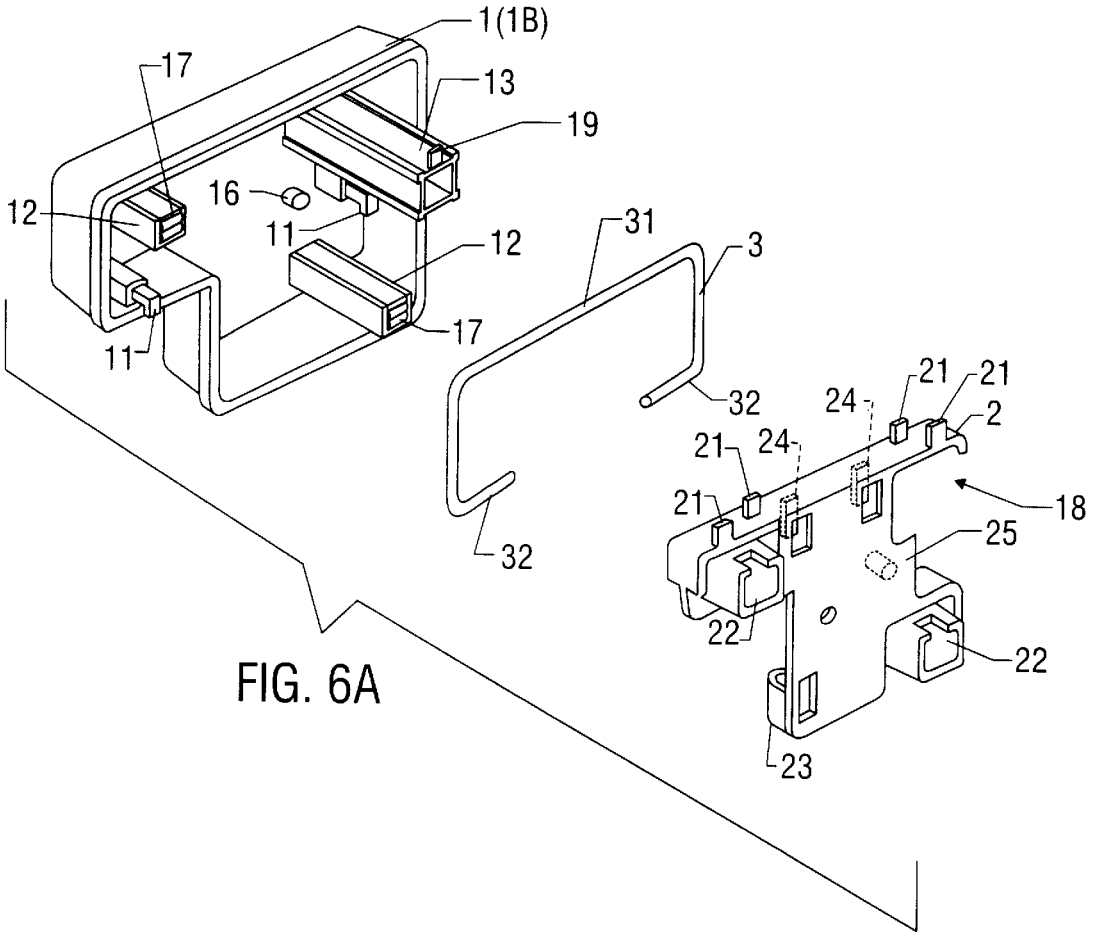
FIG. 6A is an exploded perspective view illustrating a triple integrated keyboard key assembly of this invention.

The triple key is shown in FIG. 6A with a triple key top or cap 1B and a swing rod 3 that is similar to the swing rod 3 shown in FIG. 2 and spans the length of the triple key. The triple key top 1B includes a contact or key plunger 13 and a pair of support plungers 12 that are spaced over three equivalent single key seats on a keyboard (not shown). The triple key top 1B further includes a wire support which may comprise a pair of upper restraints, supports, grooves, hooks, slots, or stoppers 11 that are desirably disposed near a middle width portion and spaced along the length of the key top 1B. Although one upper stopper 11 may be sufficient, a pair of upper stoppers 11 are advantageously provided for stability. The pair of upper stoppers 11 are desirably spaced such that they may engage either the center portion 31 or the pair of swing tips 32 (as shown in FIG. 4) of the swing rod 3. The upper stoppers 11 are advantageously sized to permit rotation or to permit both rotational and horizontal sliding motions of the swing tips 32 relative to the upper stoppers 11.

The key bottom or base 2 includes a wire guide which may comprise a pair of lower restraints, supports, grooves, hooks, or slots 21 disposed generally along the front edge and spaced along the length of the key base 2. The lower slots 21 extend toward the front edge of the key base 2 and are desirably sized to engage the swing rod 3. The lower slots 21 are advantageously spaced from the upper stoppers 11 in a manner to support the swing rod 3 for balanced vertical displacements between the key top 1B and the key base 2 as required to achieve the proper key stroke for a given keyboard. Although one lower slot 21 may be sufficient, a pair of lower slots 21 are advantageously provided for stability. The pair of lower slots 21 are desirably spaced such that they may engage either the center portion 31 (as shown in FIG. 4) or the pair of swing tips 32 of the swing rod 3. The lower slots 21 are advantageously sized to permit rotation or to permit both rotational and horizontal sliding motions of the center portion 31 of the swing rod 3. In the embodiment shown in FIG. 6A, the upper stoppers 11 are sized to permit both rotational and horizontal sliding motions of the swing tips 32 and the lower slots 21 are sized to permit only rotation of the center portion 31 of the swing rod 3 for stability and balance. The lower slots 21 and upper stoppers 11 are shown to be spaced horizontally from each other by approximately the width of a single key, similar to the spacing for the double key shown in FIG. 2, but the spacing may be changed without adversely affecting the function of the swing rod 3. It is also understood that the positions of the upper stoppers 11 and lower slots 21 may shift along the width of the triple key without affecting the balancing function of the swing rod 3 along the length of the triple key.

The key base 2 of FIG. 6A further includes a pair of support plunger guides 22 providing hollow channels of sizes through which the corresponding support plungers 12 of the key top 1B may extend generally vertically. Advantageously, the support plunger guides 22 provide sufficient clearance in the hollow channels to allow the corresponding support plungers 12 to move freely therethrough. The support plungers 12 and support plunger guides 22 position the key top 1B relative to the key base 2 and facilitate the assembly of the two components. In one embodiment, a mechanism such as small tabs or stoppers (not shown) inside the hollow channels of the support plunger guides 22 may advantageously be used to engage small hooks 17 at the free end of the support plungers 12 to prevent the support plungers 12 from sliding completely out of the hollow channels and becoming disengaged from the support plunger guides 22. The key plunger 13 of the key top 1B advantageously extends past the key base 2 when assembled. FIG. 4 shows an open region 18 in the key base 2 to accommodate the key plunger 13.

As best seen in the assembled view of FIG. 5, the triple key includes a spring 5 supported between an upper spring constraint, guide, or support 16 provided in the key top 1B and a lower spring constraint, guide, or support 25 provided in the key base. The spring 5 is illustrated as a coil spring, and the upper spring support 16 and lower spring support 25 are rounded tabs sized to support the spring 5. The spring 5 is advantageously provided as a force compensator for the large keys with larger weight than a single key. The spring 5 maintains a resistance that is generally similar to that for a single key and thus requires a pressing force by a human finger that is similar to the pressing force necessary for a single key. The appropriate spring constant for the spring 5 may be determined by those of ordinary skill in the art without undue experimentation. The location of the spring 5 is desirably near the middle region of the key, but may be away from the middle region without affecting the function of the spring 5. The spring 5 may also be used in conjunction with the double key of FIG. 2, but is not necessary because the weight of the double key is not sufficiently different from the weight of the single key. It is understood that other types of resilient springs or members that exert a reaction force under compression and other corresponding upper and lower spring supports may be used.

Figure 6B:
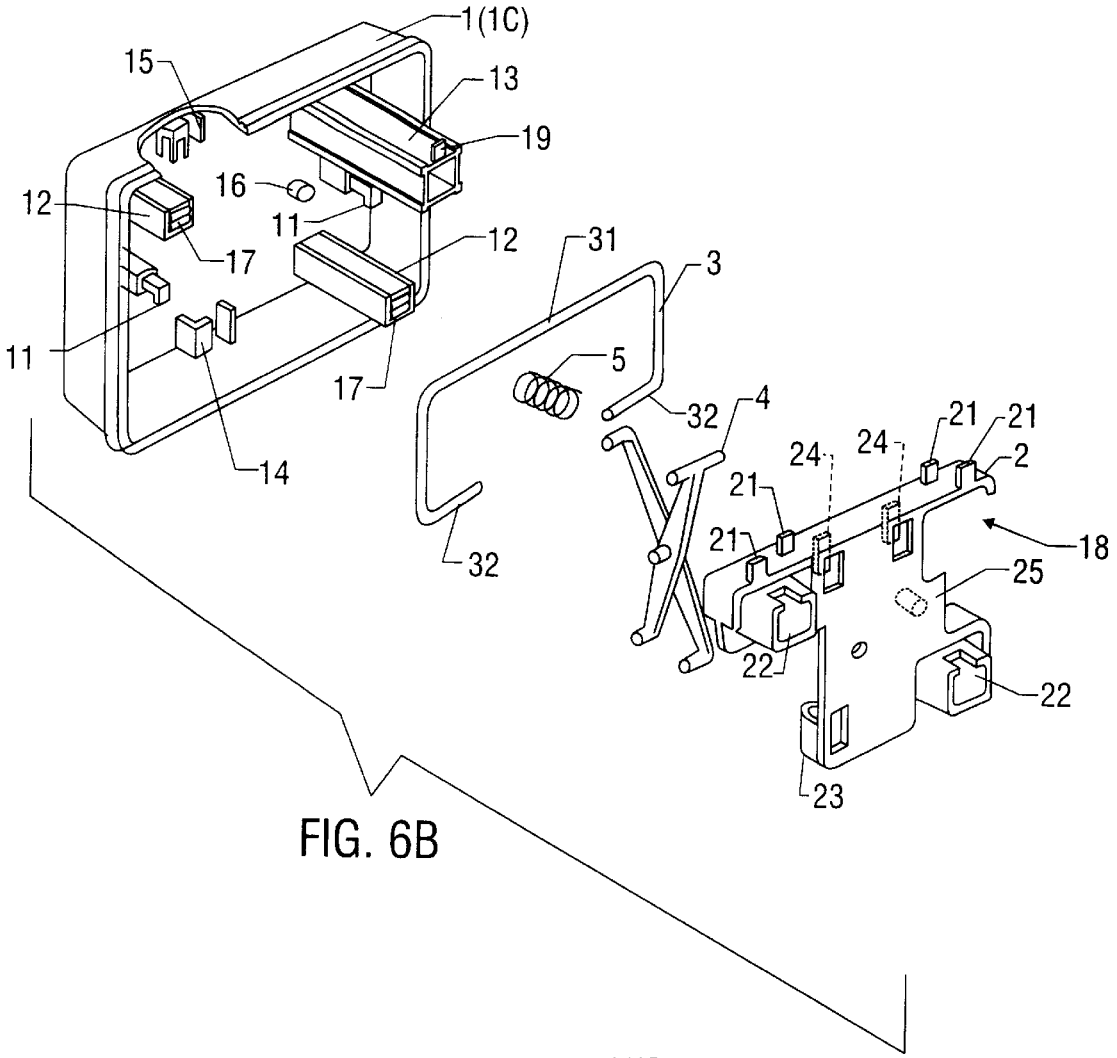
FIG. 6B is an exploded perspective view illustrating a quad integrated keyboard key assembly of this invention.

The triple key can further include a cross member 4, as illustrated in FIG. 6B, supported between a pair of upper cross constraints 14, 15 provided in the key top 1B and a pair of lower cross constraints 23, 24 provided in the key base 2. The cross member 4 shown comprises a pair of blades rotatably connected at the center. The blades advantageously have generally rounded, transverse tabs at the ends that are rotatably supported by the upper and lower cross constraints (14, 15, 23, 24). Each of the upper cross constraints includes the angled member, hook, or tab 14 and a protruding member or tab 15 that cooperate with the rounded tabs on the cross member 4 to connect the cross member 4 to the key top 1B . The lower cross constraint 23 is similar to the upper cross constraints, having an angled member, hook, or tab similar to the angled tab 14 and a protruding member or tab similar to the protruding tab 15. For added stability, the lower cross constraint 24 comprises a pair of angled members, hooks, or tabs that cooperate with the rounded tab extending in both transverse directions as shown in FIG. 6B. The rounded tabs of the cross member 4 are desirably supported for both rotation and horizontal sliding motion relative to the respective lower cross constraints 23, 24 or upper cross constraints 14, 15.

The cross member 4 is advantageously provided to balance the force on the triple key top 1B along the width of the key, because the width spans over two single key widths. Therefore, the cross member 4 serves the same function as the swing rod 3, but along the width rather than the length of the triple key. It is understood that other suitable cross constraints may also be used for balancing the force on the key. Indeed, a second swing rod (not shown) oriented along the width of the triple key top 1B may be used in place of the cross member 4.

Figure 7:
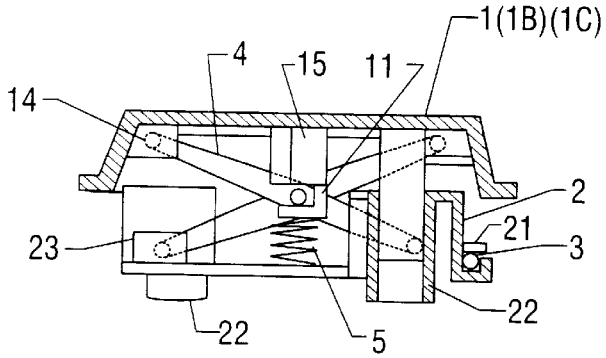
FIG. 7 is a partial cross-sectional view illustrating the assembled quad integrated keyboard key assembly of FIG. 6B.

Referring to the assembled triple key shown in FIG. 7, the swing tips 32 are snapped onto the upper stoppers 11 of the triple key top 1B and the center portion 31 of the swing rod 33 is snapped onto the lower slots 21 of the key base 2. Advantageously, the center portion 31 is rotatable relative to the lower slots 21 and the swing tips 32 are rotatable and horizontally slidable relative to the upper stoppers 11. The cross member 4 is rotatably connected between the upper cross constraints 14, 15 and lower cross constraints 23, 24. The swing rod 3 balances the force on the triple key top 1B along the length of the key while the cross member 4 balances the force on the triple key top 1B along the width of the key. The key top 1B is allowed to travel vertically relative to the key base 2 between a top position and a bottom position during a key stroke, while the swing rod 3 moves by rotation of the center portion 31 and rotation and horizontal sliding motion of the swing tips 32, and the cross member 4 moves by rotation and horizontal sliding motion of its rounded tips.

To assemble the key assembly with the keyboard, the key plunger 13 is inserted into a key slot, contact guide, or stem guide 40, as illustrated in FIG. 5, provided in a key seat of the keyboard. The key guide 40 of the key seat resiliently supports the key plunger 13 for movement of the key plunger 13 during compression of a key stroke to produce a key contact or electrical contact. The support plunger 12 and plunger guide 22 advantageously rest on top of another key guide (not shown) of an adjacent key seat for balanced support of the double key. Because the support plunger 12 is not long enough to penetrate the support plunger guide 22 into the key guide, the contact provided inside the key guide becomes a dummy contact. The support plunger 12 acts as a false or dummy key plunger. The key base 2 may also advantageously be supported on the keyboard.

The swing rod 3 and the cross member 4 form a balancing or stabilizing mechanism to ensure that uniform force transmission is achieved for smooth operation of the triple key and the key guide 40 is free of any significant tipping moments even when the key top 1B is actuated eccentrically. The eccentric force along the length of the triple key is deflected by the swing rod 3 which is rotatably supported along the length of the integrated key. The eccentric force along the width of the triple key is deflected by the cross member 4 which is rotatably supported along the width of the integrated key. The swing rod 3 and cross member 4 balance the eccentric forces and are advantageously provided so that the triple key can be adapted to replace three single keys by occupying three single key slots.

C. Quad Key

The quad key differs from the triple key only in that the quad key top 1C takes up the room of four single keys while the triple key top 1B takes up the room of only three single keys, as shown in FIG. 4. The remaining components and operation of the quad key are similar to those of the triple key.

In FIG. 6B, the quad key top 1C has only two support plungers 12 as in the triple key top 1B. In an alternative embodiment, the quad key top 1C may include an additional support plunger 12 and the key base 2 may include a corresponding support plunger guide 22 disposed over the fourth single key seat on the keyboard (not shown). This additional support plunger 12 is not necessary, however, because the two support plungers 12 and key plunger 13 as configured are sufficient to position and support the quad key top 1C relative to the key base 2.

As illustrated in the double-key, triple-key, and quad-key embodiments discussed above, the integrated key assembly can be adapted to a wide range of multiple-key applications beyond the three embodiments shown. The use of multiple tabs or protrusions 19' on the key plunger 13 to orient the double key in various directions relative to the keyboard as shown in FIGS. 4 and 5 is also applicable to the triple and quad keys (not shown). The integrated key assembly in accordance with this invention can be easily used to replace multiple single keys in existing keyboards without the need to reconfigure the key seats in the keyboards.

It will be understood that the above-described arrangements of apparatus and the methods therefrom are merely illustrative of applications of the principles of this invention and many other embodiments and modifications may be made without departing from the spirit and scope of the invention as defined in the claims.

What is claimed is:

1. A key assembly for use on a keyboard, comprising:

a key top having a first constraint, a key plunger for detachably penetrating through a key plunger guide provided in a keyboard, and at least one support plunger extending generally parallel to and spaced from said key plunger;

a key base having at least one support plunger guide through which said at least one support plunger movably extends and a second constraint spaced from said first constraint;

a swing rod having a shaft, and at least one arm extending from said shaft to a tip, said shaft and said tip being rotatably connected to said first constraint and to said second constraint; and a movable cross member having a pair of upper rounded tips rotatable and slidably connected to said key top and a pair of lower rounded tips rotatable and slidably connected to said key base said cross member extending substantially across the width of said key top.

2. The key assembly of claim 1, wherein said first constraint comprises a pair of first slots along a rear edge of said key top.

3. The key assembly of claim 1, wherein said second constraint comprises a pair of second slots along a front edge of said key base.

4. The key assembly of claim 1, wherein said tip of said swing rod extends from said shaft to a position that is spaced from and generally parallel to said shaft.

5. The key assembly of claim 1, wherein said swing rod comprises a shaft, a first arm extending from said shaft to a first tip, and a second arm extending from said shaft to a second tip, said shaft and said first and second tips in rotatable and sliding connection with said first and second tips.

6. The key assembly of claim 5, wherein said first tip and said second tip extend from said shaft to a position that is spaced from and generally parallel to said shaft.

7. A multiple-key unit comprising:

a key top having a key plunger for engaging a key contact in a keyboard, a first constraint, and at least one support plunger;

a key base having at least one support plunger guide for cooperative sliding engagement with said support plunger and a second constraint; and a generally U-shaped swing rod disposed between said key top and said key base, said swing rod further comprising a shaft extending to two free ends that are substantially parallel to said shaft, said free ends and said shaft in rotatable and sliding engagement with said first and said second constraints; and a cross member which includes a first blade rotatable connected to a second blade, said first blade including a first upper tip rotatable connected to said key top and a first lower tip rotatable connected to said key base, said second blade including a second upper tip rotatably connected to said key top and a second lower tip rotatably connected to said key base.

8. The key assembly of claim 7, further comprising a compression spring connected between said key top and said key base.

9. The multiple-key unit of claim 7, wherein said second constraint comprises at least one groove or slot disposed near a front edge of said base portion.

10. The multiple-key unit of claim 9, wherein said first constraint comprises at least one groove or slot disposed near a rear edge of said key top opposite from said front edge of said key base.

11. The multiple-key unit of claim 7, wherein said first upper tip is connected to a tab provided near a front edge of said key top, said second upper tip is connected to a tab provided near a rear edge of said key top opposite from said front edge, said first lower tip is connected to a tab provided near a rear edge of said key base which corresponds to said rear edge of said key top, said second lower tip is connected to a tab provided near a front edge of said key base which corresponds to said front edge of said key top portion.

12. The multiple-key unit of claim 11, wherein said second constraint comprises at least one groove disposed near said front edge of said key base and said first constraint comprises at least one groove disposed near said rear edge of said key top.

13. A keybutton assembly comprising:

a key top including a mating stem extending in a first direction for disengageably mating with a mating sleeve and contacting a key contact provided in a keyboard;

a key bottom; and a swing rod having a center portion extending to a pair of free tips that are substantially parallel to said center portion, said center portion being rotatably and slidably supported near a front edge of said key top, said pair of free tips being rotatably supported near a rear edge of said key bottom opposite from said front edge of said key top thereby supporting said key top with respect to said key bottom for balanced movement generally in said first direction between a pressed position with the application of a pressure on said key top and a relaxed position upon the release of said pressure, said mating stem being spaced from said key contact in said relaxed position and contacting said key contact in said pressed position; and a cross member having a first blade rotatably connected to a second blade, said first blade including a first upper tip rotatably and slidably connected to said key top and a first lower tip rotatable connected to said key bottom, said second blade including a second upper tip rotatable connected to said key top and a second lower tip rotatable and slidably connected to said key bottom, wherein said first upper tip is connected to a tab provided near a from edge of said key top, said second upper tip is connected to a tab provided near a rear edge of said key top opposite from said front edge, said first lower tip is connected to a tab provided near a rear edge of said key bottom which corresponds to said rear edge of said key top, said second lower tip is connected to a tab provided near a front edge of said key bottom which corresponds to said from edge of said key top.

14. The keybutton assembly of claim 13, wherein said center portion is supported by at least one slot near said front edge of said key top and said pair of free tips are supported by at least one slot near said rear edge of said key bottom.

15. The keybutton assembly of claim 13, wherein said means comprises at least one balancing stem extending from said key top generally parallel to said first direction and supported by at least one balancing sleeve provided in said keyboard, said at least one balancing stem slidably guided by at least one balancing stem guide provided in said key bottom.

16. The keybutton assembly of claim 13, wherein said mating stem includes a tab which engages a mating stem support provided in said mating sleeve in said pressed position, with said keybutton assembly oriented relative to said keyboard in a first direction.

17. The keybutton assembly of claim 16, wherein said mating stem includes at least one auxiliary tab oriented nonparallel to said tab, said at least one auxiliary tab engageable with said mating stem support in said mating sleeve to orient said keybutton assembly relative to said keyboard in said pressed position in a direction different from said first direction.

18. The keybutton assembly of claim 13, further comprising a compression spring connected between said key top and said key base.

19. A keybutton assembly comprising:

a key top including a mating stem extending in a first direction for disengageably mating with a mating sleeve and contacting a key contact provided in a keyboard, said mating stem including a tab which engages a mating stem support provided in said mating sleeve in said pressed position, with said keybutton assembly oriented relative to said keyboard in a first direction, and at least one auxiliary tab oriented nonparallel to said tab, said at least one auxiliary tab engageable with said mating stem support in said mating sleeve to orient said keybutton assembly relative to said keyboard in said pressed position in a direction different from said first direction; and a key bottom; and a swing rod having a center portion extending to a pair of free tips that are substantially parallel to said center portion, said center portion being rotatably and slidably supported near a front edge of said key top, said pair of free tips being rotatably supported near a rear edge of said key bottom opposite from said front edge of said key top thereby supporting said key top with respect to said key bottom for balanced movement generally in said first direction between a pressed position with the application of a pressure on said key top and a relaxed position upon the release of said pressure, said mating stem being spaced from said key contact in said relaxed position and contacting said key contact in said pressed position.

* * * * *

UNITED STATES PATENT AND TRADEMARK OFFICE

CERTIFICATE OF CORRECTION

PATENT NO. : 5,941,373

DATED : August 24, 1999

INVENTOR(S) : Tsung-Kan Cheng

It is certified that error appears in the above-identified patent and that said Letters Patent is hereby corrected as shown below:

On the title page, item [56]

Under References Cited, U.S. Patent Number 4,771,146 should be dated 9/1988

In column 9, claim 1, line 27, "rotatable" should read --rotatably--

In column 9, claim 1, line 28, "rotatable" should read --rotatably--

In column 9, claim 1, line 29, "base said" should read –base, said--

In column 9, claim 7, line 63, "rotatable" should read --rotatably--

In column 9, claim 7, line 65, "rotatable" should read --rotatably--

In column 9, claim 7, line 66, "rotatable" should read --rotatably--

UNITED STATES PATENT AND TRADEMARK OFFICE

CERTIFICATE OF CORRECTION

PATENT NO. : 5,941,373

DATED : August 24, 1999

INVENTOR(S) : Tsung-Kan Cheng

It is certified that error appears in the above-identified patent and that said Letters Patent is hereby corrected as shown below:

In column 10, claim 13, line 49, "rotatable" should read --rotatably--

In column 10, claim 13, line 50, "rotatable" should read --rotatably—

In column 10, claim 13, line 52, "rotatable" should read --rotatably--

In column 10, claim 13, line 54, "from" should read --front--

In column 10, claim 13, line 61, "from" should read --front--

Signed and Sealed this

Thirtieth Day of May, 2000

*Attest:*

*Attesting Officer*

Q. TODD DICKINSON

*Director of Patents and Trademarks*